United States Patent [19]

Taysom et al.

[11] 4,076,124

[45] Feb. 28, 1978

[54] MECHANICAL EARTHWORM HARVESTER

[75] Inventors: Dell A. Taysom; Larry D. Taysom; Robert J. De Witt; Carl S. De Witt, all of Hemet, Calif.

[73] Assignee: Carroll S. Mohr, Fountain Valley, Calif.

[21] Appl. No.: 769,176

[22] Filed: Feb. 16, 1977

[51] Int. Cl.[2] ..... B07C 1/10

[52] U.S. Cl. ..... 209/75; 209/84; 209/114; 209/308

[58] Field of Search ..... 209/75, 84, 114, 307, 209/308

[56] References Cited

U.S. PATENT DOCUMENTS

| | | | |
|---|---|---|---|
| 1,468,301 | 9/1923 | Hoxter | 209/307 |
| 1,881,239 | 10/1932 | Paulson | 209/84 |
| 2,350,332 | 6/1944 | Albaugh | 209/114 |

*Primary Examiner*—Allen N. Knowles
*Attorney, Agent, or Firm*—Edgar W. Averill, Jr.

[57] ABSTRACT

A vibrating, moving, endless screen for separating earthworms from worm castings and bedding. An endless belt fabricated from a screen is placed on an incline and moved upwardly in the direction of the incline. A portion of the moving surface is vibrated and a mixture of worm bedding, castings and earthworms is placed along the upper surface. The worms are conveyed over the upper end of the belt. The worm castings and bedding fines pass through the belt and the larger bedding material passes downwardly over the screen surface and passes over the lower end of the moving endless belt.

6 Claims, 5 Drawing Figures

MECHANICAL EARTHWORM HARVESTER

BACKGROUND OF THE INVENTION

The production of earthworms for bait, animal feed and agricultural purposes is a growing business. Typically, earthworms are raised in worm beds and when the worms are mature they must be separated from the bedding material and from the worm castings. The worm castings have been recognized as a highly effective organic fertilizer and the re-claiming of this resource has become a valuable adjunct to the business of raising earthworms.

The separation of earthworms from other bedding material has classically been carried out by placing the mixture on the upper surface of a screen which is typically tilted or shaken to permit the castings to pass through the screen and to hold the worms on the upper surface of the screen. Such an approach has limited capacity, however, since oversized and agglomerated bedding material quickly clogs the pores of the screen necessitating an interruption of the separating process. While most bedding material would be expected to pass through screen openings of approximately ¼ to ½ inch in size, the mechanical vibration of the screen used in an attempt to increase production tends to agglomerate the bedding material into larger particles. The result is that the bedding material is held on the upper surface of the screen together with the worms and the process must be stopped to perform this secondary separation of bedding material from worms.

SUMMARY OF THE INVENTION

It is an object of the present invention to provide a device for separating earthworms from bedding material and from worm castings on a high volume, continuous basis.

The present invention is for an earthworm separating device comprising an endless belt fabricated from a screen having a mesh size having openings between 3/16 and ½ inches. The upper surface of the upper belt is designated the separating surface. The separating surface is held on an incline of between 1° and 15° with respect to the horizontal. The endless belt is driven in an upward direction with respect to the incline at a speed of between 0.5 and 5.0 feet per second and vibrating means are positioned near the lower end of the separating surface.

A mixture of worms in bedding material is deposited on the upper surface of the separating surface and the worms are held on the separating surface whereas the worm castings and small size bedding material passes through the vibrating screen. The worms then pass upwardly and over the end of the endless screen and are thereby separated from the bedding material and castings. The worm castings pass through the separating surface and are collected for use as a plant nutrient. A portion of the bedding material tends to be "balled up" by the vibrating action of the moving screen and, because of the incline, rolls downwardly and at the opposite end of the moving screen or belt from the end over which the worms are removed. The initial worms and bedding are thus separated into three distinct groupings namely worms, worm castings also containing bedding fines and agglomerated worm bedding.

DESCRIPTION OF THE PREFERRED EMBODIMENTS

Figure 3:
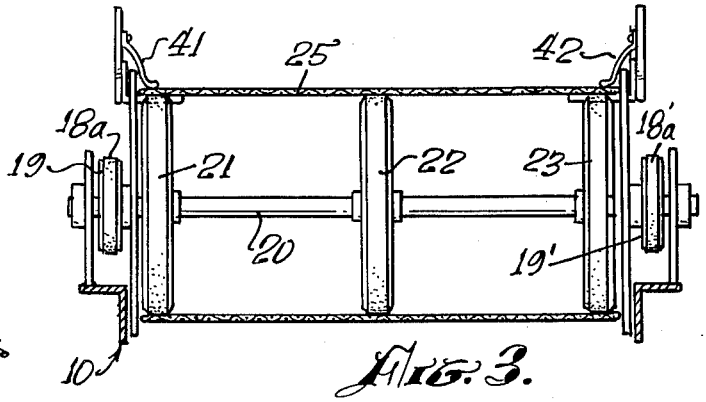
FIG. 3 is a fragmentary end view taken along lines 3—3 of FIG. 1.

The mechanical earthworm harvester is supported on a frame 10 which has a pair of adjustable legs 11 for adjusting the horizontal incline of the harvester. Because of the different consistency of various bedding materials it is appropriate that the angle of inclination of the separating surface be adjustable over a relatively wide range and a pair of tightening screws 12 and 13 hold the frame in any desired degree of inclination. A motor and gear box 14 is mounted on frame 10 and provides all the mechanical drive and source of vibration necessary for operation of the harvester. A first belt 15 passes over a pulley 16 which drives the central shaft 17 to which pulley 18 is affixed. Pulley 17 drives the second belt **18*a* which passes over a pulley 19 which is also shown in end view in FIG. 3. Pulley 19 drives a shaft 20 to which three wheels 21, 22 and 23 are affixed. A second belt 18*a* and pulley 19' are also driven by shaft 17 in a manner analogous to that described for belt 18 and pulley 19**.

The endless belt or screen 25 passes over the exterior surface of three wheels 21 through 23 and over a similar set of idler wheels at the other end of the screen 25. These wheels are held on shaft 26 which is in turn, held in a moveable bearing provided with adjustment means 27 for adjusting the tension of the belt. The upper surface of belt 25 comprises the separating surface. Vibrating means, indicated generally by reference character 30 provides the necessary vibration for the separator surface. The vibration is brought about by an eccentric shaft which is welded to shaft 24 which is rotated by pulley 31' which is turned by belt 31. Shaft 24 has an outside diameter of ½ inch and a flat portion ⅛ inch in depth is milled from the surface of the shaft for a distance of one inch from the inner end. An eccentric shaft 28 also has a ½ inch diameter and a ⅛ inch flat portion milled from its surface for a distance of one inch on each end. The flat surface of shaft 24 is welded to the flat surface of shaft 28 at one end and to a corresponding shaft 24' (not shown). A pair of arms 32 and 32' (not shown) transmit this eccentric motion to upper frame 33 and thus to the separating surface of the screen or belt 25.

It has been found that by locating the vibrator near the lower end of the separating surface, that the maximum amount of vibration occurs at a point when the worms are best protected by the bedding. As the bedding and castings are separated from the worms and the worms move upwardly along the belt the amount of vibration decreases thereby reducing damage to the worms. This vibrating action also tends to cause unused bedding material to be formed into balls which roll down the incline rather than being moved upwardly with the worms.

In operation, the original worm tray 35 is placed on a support 36 and the worms, castings, and bedding are fed into a feeder screen 37 which is made of a larger mesh screen than screen 25. Typically the moving screen or belt should have an opening sizes of about 3/16 and ½ inches and preferably about ¼ inch in size whereas the feeder screen should preferably have an opening size of from about ⅜ to ¾ inches preferably about ½ inch. Feeder screen 37 is also vibrated and any over-sized material is removed from the upper surface of screen 37. Screen 37 performs an initial breaking up or separation of the worm bedding and the partially separated material falls onto the separating surface upon which the final separation is made.

Figure 5:
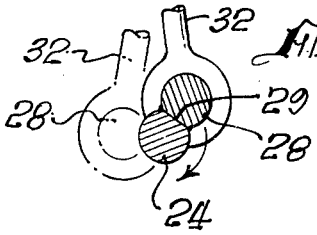
FIG. 5 is an enlarged, fragmentary view of the vibrating means of the harvester of FIG. 1.
Figure 1:
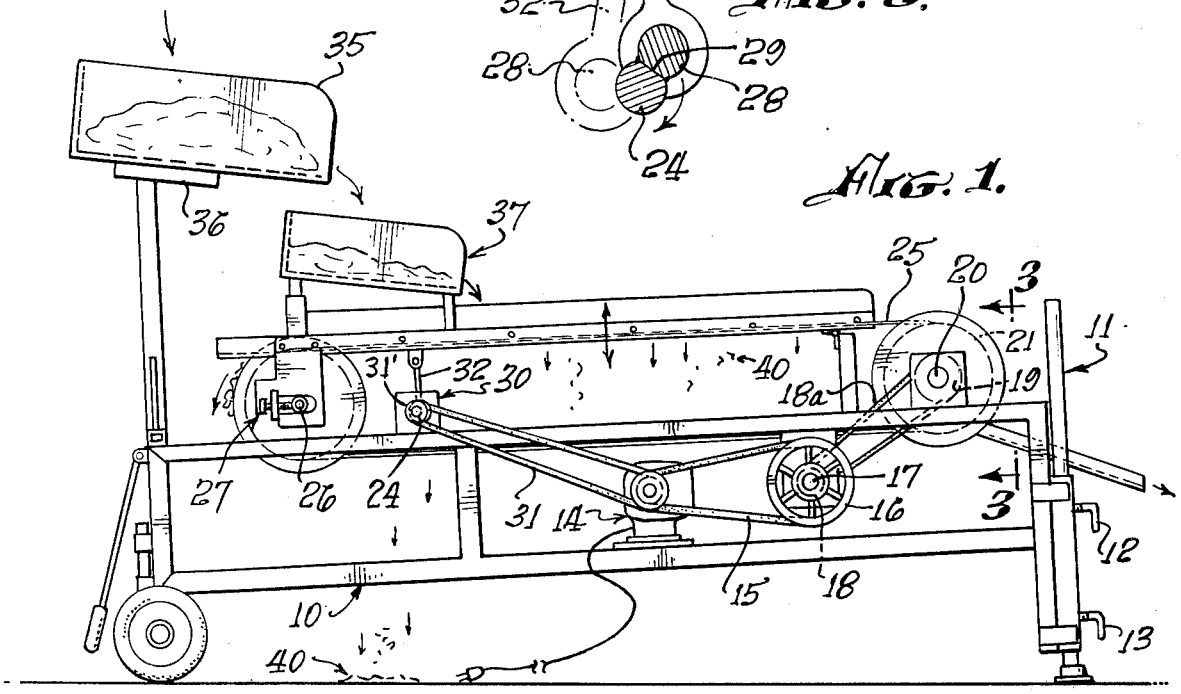
FIG. 1 is a side elevation of the mechanical earthworm harvester of the present invention.
Figure 2:
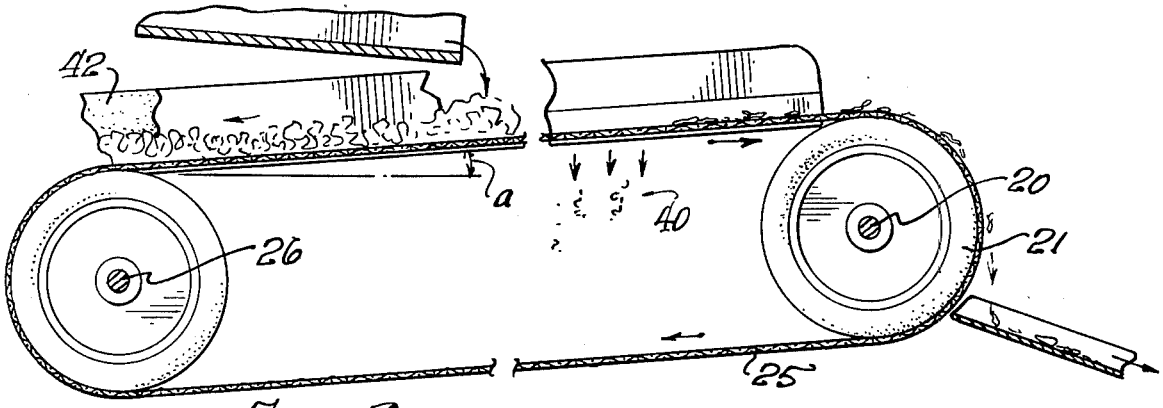
FIG. 2 is an enlarged fragmentary side elevation partially cut-away showing the moveable belt of the harvester of FIG. 1.
Figure 4:
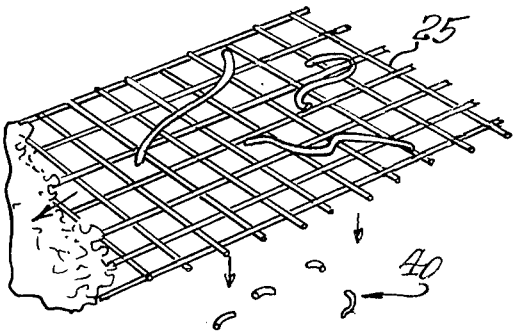
FIG. 4 is an enlarged perspective view of a portion of the screen of the harvester of FIG. 1.

As shown best in FIG. 2, the angle of incline "*a*" of the separating surface is set such that the bedding material moves down the incline and the worms are carried upwardly along the upper surface of screen 25. The proper angle of incline depends on the nature of bedding material, size of screen mesh, speed of belt movement and amount of vibration. It has been found that inclination angles between 1° and 15° are useful with 5° being average for most conditions. The castings indicated in FIG. 4 generally by reference character 40 pass through the separating screen 25 and may either be collected directly below the screen or may be permitted to fall through the returning moveable screen and collected on the ground.

Gear box 14 has an output of 135 rpm and an output pulley of 4 inches diameter. This 4 inch output pulley passes over pulley 16 which is ten inches in diameter which turns a two inch pulley 18 at a speed of 33 ¾ rpm. Pulley 18 is connected to belt 18*a* which turns pulley 19 and shaft 20 at 27 rpm. The diameter of wheels 21 22, and 23 is ten inches and thus the separating surface moves at a rate of 1.2 feet per second. This speed permits the high volume harvesting of worm beds and production rates of up to 60 lbs. per hour have been obtained. This production rate was obtained with a separating surface approximately 6½ feet in length and 2 feet in width and a screen opening size of ¼ inch. Speeds between 0.3 and 5 ft. per second can be used with about 1 ft. per second being preferred.

The vibrating shaft 24 is turned at a speed of 270 rpm, which has been found to provide ample vibration. Vibration rates between 100 and 500 cycles per second are believed useful in the practice of the present invention. A pair of rubber liners 41 and 42 serve to transmit the vibration from frame 33 to the belt or screen 25. They also tend to hold the bedding and worms on the separating surface of screen 25. While the screen can be fabricated from any material having appropriate physical strength and corrosion resistance it has been found that galvanized wire is suitable for this use.

The present embodiments of this invention are thus to be considered in all respects as illustrative and not restrictive, the scope of the invention being indicated by the appended claims rather than by the foregoing description. All changes which come within the meaning and range of equivalency of the claims therefore are intended to be embraced therein.

What is claimed is:

1. A device for separating earthworms from bedding and worm castings, said device comprising;

and endless belt fabricated from a screen having a mesh size of between 3/16 and ½ inches, said endless belt having an upper separating surface held at an incline of about 1° to 15° with respect to the horizontal;

drive means for moving said belt in the direction of the upward incline at a speed of between 0.3 and 5 feet per second;

vibrating means for vibrating the separating surface so that when a mixture of earthworm bedding material containing earthworms, bedding and worm castings is placed on the separating surface, the worms are conveyed upwardly along the separating surface and pass over the upper edge thereof, the worm castings pass through the separating surface and a substantial portion of the bedding material moves downwardly along the incline separating surface and passes over the lower edge thereof.

2. The device of claim 1 wherein said endless belt has a mesh size of about ¼ inch.

3. The device of claim 1 wherein said belt is moved at a speed of approximately 1 feet per second.

4. The device of claim 1 wherein said separating surface is vibrated at an oscillation rate between 100 and 500 cycles per second.

5. The device of claim 4 wherein said separating surface is vibrated at an oscillation of approximately 270 cycles per second.

6. The device of claim 1 further including a large mesh feeder screen having a mesh size larger than said endless belt and affixed above the separating surface of the device whereby an initial separation is made before the earthworms and bedding materials are placed on the separating surface.

* * * * *